United States Patent [19]

Kitai et al.

[11] 3,996,734

[45] Dec. 14, 1976

[54] MINUTE-INTERVAL ALARMING DEVICE FOR A CLOCK OR THE LIKE

[75] Inventors: Kiyoshi Kitai, Tokyo; Masuo Ogihara, Chiba; Kouzo Sato, Yotsukaido; Nobuo Shinozaki, Chiba, all of Japan

[73] Assignee: Seiko Koki Kabushiki Kaisha, Japan

[22] Filed: Apr. 23, 1975

[21] Appl. No.: 570,776

[30] Foreign Application Priority Data

Apr. 26, 1974 Japan ..... 49-47947[U]

[52] U.S. Cl. ..... 58/38 R; 58/16 R; 58/18; 58/19 A; 58/125 B

[51] Int. Cl.[2] ..... G04B 23/10; G04C 21/36

[58] Field of Search ..... 58/38 R, 16 R, 16.5, 58/18, 19 R, 19 A, 125 R, 125 A, 126 R, 126 A; 235/61 A

[56] References Cited

UNITED STATES PATENTS

| | | | |
|---|---|---|---|
| 2,579,166 | 12/1951 | Youhouse | 58/125 B X |
| 3,474,617 | 10/1969 | Robinson et al. | 58/16.5 |
| 3,524,314 | 8/1970 | Morton et al. | 58/18 |
| 3,673,787 | 7/1972 | Kovacevic | 58/125 B X |
| 3,857,234 | 12/1974 | Flumm et al. | 58/125 B X |

*Primary Examiner*—Stanley J. Witkowski
*Attorney, Agent, or Firm*—Robert E. Burns; Emmanuel J. Lobato; Bruce L. Adams

[57] ABSTRACT

An alarming device for a clock comprises a rotationally driven minute time wheel having plural sets of shift teeth, a rotatable 10-minutes time wheel which intermittently meshes with the shift teeth of the minute time wheel to be driven thereby, and a rotatable hour time wheel which intermittently meshes with the 10-minutes time wheel and is driven thereby. First and second detection devices respectively detect when the 10-minutes and hour time wheels are in predetermined angular positions, and setting means enables setting of the detection devices in predetermined positions. An audible alarm is rendered operative and provides an audible alarm only when the 10-minutes time wheel and the hour time wheel have respectively conformed in phase with said first and second detection devices thereby providing notification of the alarm time. The first detection device is provided with alarm time indicating indicia each of which represents one-figure minutes selected in accordance with the number of said shift teeth of the minute time wheel, and the second detection device is provided with alarm time indicating indicia representing hours.

7 Claims, 2 Drawing Figures

MINUTE-INTERVAL ALARMING DEVICE FOR A CLOCK OR THE LIKE

BACKGROUND OF THE INVENTION

The present invention relates to an alarming device wherein the alarm time can be properly set at fractional one-figure minute intervals.

The conventional alarming device employed thus far for clocks has an alarm time 10-minute setting wheel and an alarm time hour setting wheel which are free to revolve and arranged in place at the positions of the desired phases for the 10-minute time wheel and the hour time wheel. The time wheels are kept in intermittent revolution at uniform speed, for the purpose of improving the precision of the alarming time, and detects when the alarm time 10-minute setting wheel and the 10-minute time wheel, and also when the alarm time hour setting wheel and the hour time wheel, are in phase conformance with each other thus conducting proper time-telling. However with such an alarming device, it is only practicable to set alarm time at 10-minute intervals.

In order to enable the alarm time to be properly set at fractional one-figure minute intervals, it is conceivable to add an alarm time minute setting wheel which is free to revolve to the position of the desired phase for the minute time wheel. However, an increase in the number of detecting points as set forth above results in an increase in the number of the constituent component parts required therefor, thus proving considerably disadvantageous in terms of the space for fitting such, the manufacturing cost, and so forth.

SUMMARY OF THE INVENTION

In accordance with the present invention, there is provided an alarm timepiece device comprising a minute time wheel, means for intermittently driving the minute time wheel through angular distances representing minutes, a 10-minute time wheel which intermittently meshes with the minute time wheel so as to be intermittently driven thereby through angular distances representing 10 minutes, an hour time wheel which intermittently meshes with the 10-minute time wheel so as to be intermittently driven thereby through angular distances representing hours, and means for indicating the time in hours, 10-minutes, and minutes. First and second angularly adjustable detection devices are provided for respectively detecting when the 10-minute and hour time wheels are in predetermined angular positions, and setting means coacts with the detection devices to set the same in angular positions corresponding to a time at which it is desired that an alarm should be given. An audible alarm is rendered operative only when the 10-minute time wheel and the first detection device, and the hour time wheel and the second detection device, are in corresponding angular positions. One of the minute and 10-minute time wheels have a plurality of angularly spaced-apart shift teeth portions, separated by non-toothed portions, which intermittently mesh with a continuously toothed portion of the other wheel. The first detection device bears alarm time indicating indicia which represent successive 5-minute intervals, and the second detection device bears alarm time indicating indicia representing hours.

Thus in the case of the present invention, the alarm timepiece device enables alarm times which are spaced from each other by time intervals of 5 minutes or less, to be easily selected by a user without having to make the alarm timepiece device of complicated construction, e.g. by having to provide a third detection device for detecting the angular position of the minute time wheel.

Preferably there is provided an actuating member which is spaced from the setting means and which is manually movable from an inoperative position and into an operative position in which it drivingly engages a predetermined detection member to adjust the position of the latter. Each movement of the actuating member into the operative position adjusts the position of the predetermined detection member by a constant amount. The actuating member comprises a pawl which, when in the operative position, engages a ratchet wheel which is connected to the said predetermined detection member. The pawl is carried by a lever which is engaged by a setting pin and which is biassed to a position in which the pawl is spaced from the ratchet wheel, the setting pin being manually movable to move the lever against the said bias and into a position in which the pawl drivingly engages the ratchet wheel.

The detection members of the time wheels may be respectively provided with electrical contact members which form part of the audible alarm. The audible alarm also has fixed contacts which are adapted to be contacted by the contact members only when the time sheels and the detection members are in the corresponding angular positions.

DETAILED DESCRIPTION OF PREFERRED EMBODIMENT

Figure 1:
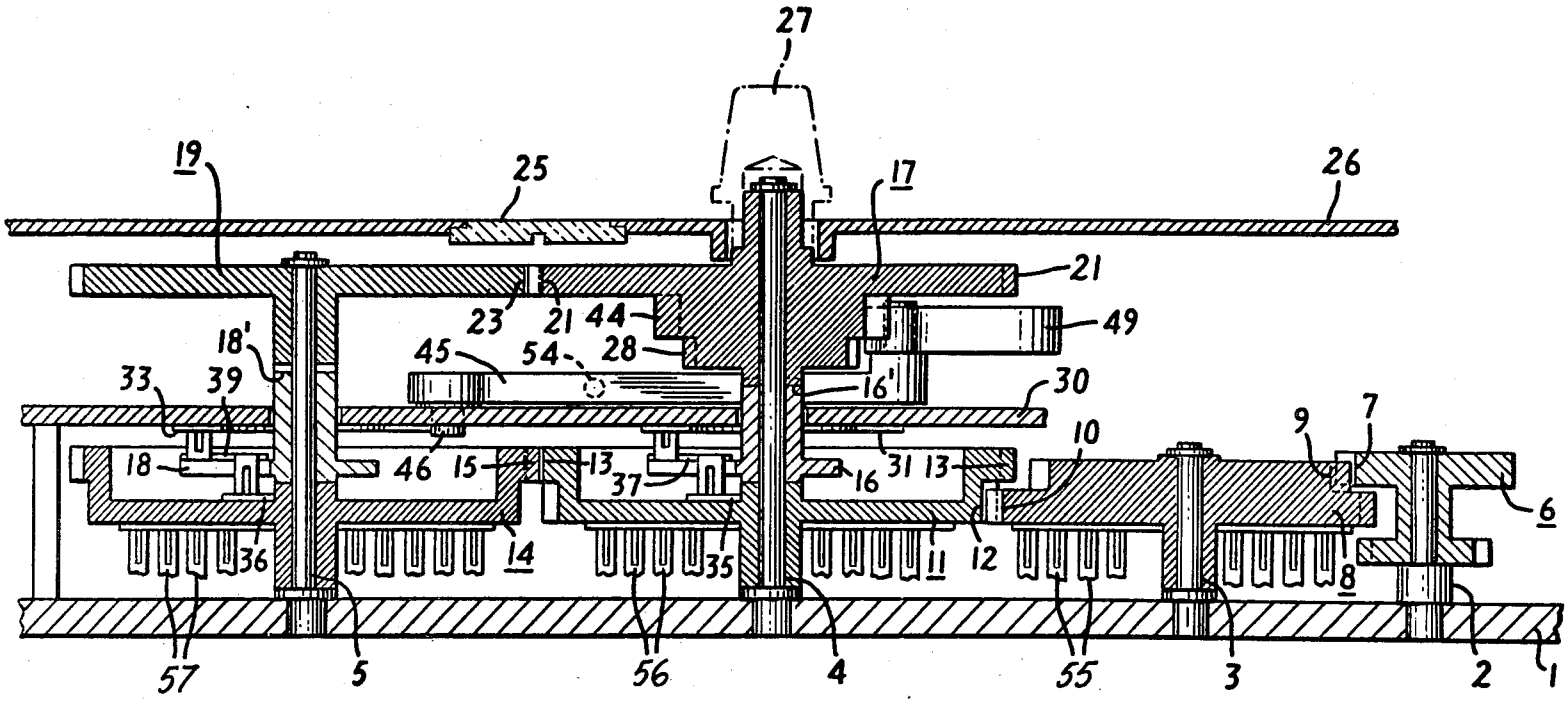
FIG. 1 is a longitudinal cross-sectional view of the major portion of the alarming device according to the invention and being shown set in place in a clock.

In FIG. 1, a base plate 1 has a series of shafts 2, 3, 4 and 5 rotatably fixed in place thereon along a straight line. The shaft 2 has a drive wheel 6 provided with a set of shift teeth 7 and is supported in such a manner as to be free to revolve, the shaft 3 has a minute time wheel 8 provided with two sets of shift teeth 10, 10 diametrically spaced apart and a set of continual teeth 9 positioned to be engaged with the said shift teeth 7, the shaft 4 has a 10-minute time wheel 11 provided with one set of shift teeth 13 as well as a series of continual teeth 12 positioned to be engaged with the said shift teeth 10, the shaft 5 has an hour time wheel 14 provided with a series of continual teeth 15 arranged to be engaged with the said shift teeth 13, and the said drive wheel 6 has a torque transmitted thereto from, for instance, a synchronous motor (not shown in the drawing). By such construction, the minute time wheel 8 is put in intermittent revolution by 36° every time thereby making one revolution in 1 minute, the 10-minute time wheel 11, is put in two intermittent revolutions of 30° each in response to one revolution of the minute time wheel 8 and, consequently makes one revolution in 60 minutes, and the hour time wheel 14, is put in one intermittent revolution of 30° each and, consequently makes one revolution in 12 hours, in response to revolution of the 10-minute time wheel 11.

The alarm time indicating mechanism is of such a constitution as is set forth below. The shaft 4 has an alarm time 5-minute setting plate member 16 and an alarm time 5-minutes indicating wheel 17 supported as alarm time 5-minute setting pieces in such a manner as to be free to revolve while being continually engaged with each other, and the shaft 5 has an alarm time hour setting plate member 18 and an alarm time hour indicating wheel 19 supported as alarm time hour setting pieces in such a manner as to be free to revolve while being continually engaged with each other.

The said 5-minute indicating wheel 17 is provided with one set of shift teeth 21 in the same manner as in the case of the 10-minute time wheel 11, and has alarm time 5-minute indications of 5-minute intervals 22 (00, 05, 10, 15, . . . 55) marked on the upper peripheral surface portion at intervals of 30°. The alarm time hour indicating wheel 19, is provided with a series of continual teeth 23 engageable with the said shift teeth 21, and has alarm time hour indications 24 (1, 2, 3, . . . 12) surface marked on the upper surface peripheral surface portion. An alarm time indicating opening 25 formed in the cover 26 of the clock, a knob 27 is set in place on the 5-minute indicating wheel, to set the call time 28 is a click wheel formed in an integrated manner at the lower section of the 5-minute indicating wheel, and 29 is a click.

Now, a description will be given below with regard to the alarm time setting detecting mechanism. The lower surface of a base member 30 is arranged in place between the time wheels 11, 14 and the indicating wheels 17, 19 has a pair of semi-ring-shaped fixed 5-minute primary and secondary slide switch plates 31, 32 and fixed hour primary and secondary slide switch plates 33, 34 fixed in place thereon along the circumference around the shafts 4, 5, respectively. The upper surface of the time wheels 11, 14 has a small fan-shaped 5-minute revolving slide switch plate 35 and an hour slide switch plate 36 fixed in place thereon at such positions as are corresponding to the inside of the respective ring-shaped pieces of the said fixed switch plates 31, 32 and 33, 34, respectively. In addition, the said 5-minute and hour alarm time setting plates 16, 18 respectively have 5-minute alarm time primary and secondary contact pieces 37, 38 which have contact pieces extended in a bifurcated shape to such positions as can come in contact with 5-minute fixed switch plates 31, 32 and the revolving switch plate 35 and also have alarm time hour primary and secondary contact pieces 39, 40 which have contact pieces extended in a bifucated shape to such positions as can come in contact with the hour fixed switch plates 33, 34 and the revolving switch plate 36. The setting plate 16, plates 31, 32, plate 35 and the contact pieces 37, 38 jointly define a first detection device for detecting when the 10-minute time wheel 11 is in a predetermined angular position; the setting plate 18, plates 33, 34, plate 36 and the contact pieces 39, 40 jointly define a second detection device for detecting predetermined angular positions of the hour time wheel 14. The plate members 16 and 18 are fixed in place in such a manner that they define with the said respective switch plates and the respective contact pieces a switching mechanism *a*.

Figure 2:
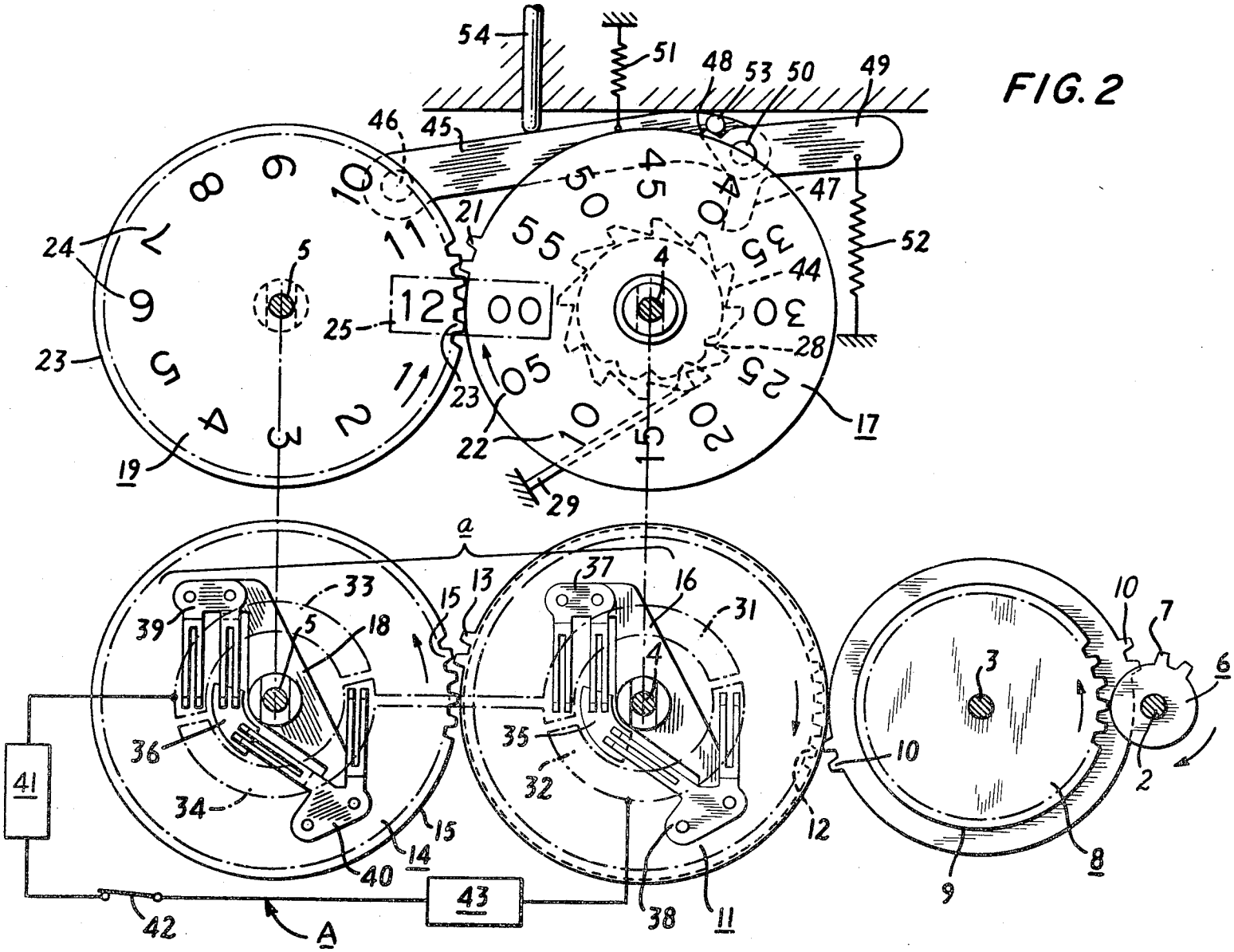
FIG. 2 is an exploded plan view of the alarm time indicating wheel and the time wheels shown separated from each other for purposes of clarity.

The time-telling mechanism is constituted of the said switching mechanism *a*, and such a circuit A comprised of a power source 41, a main switch 42 and an audible alarm in the form of a buzzer 43 connected as shown in FIG. 2 therewith.

Now, in the state shown in FIG. 2, the indicating opening has the alarm time of 12.00 (12 o'clock) indicated in the indicating opening 25, and the switching mechanism *a* is closed, thus putting the buzzer 43 in the state of buzzing. When the knob 27 is turned clockwise by 30° in this case to indicate 12:05 (5 minutes past 12 o'clock), the 5-minute setting plate 16 is turned clockwise by 30°, and the primary and secondary contact pieces 37, 38 are displaced to a position 30° from the revolving switch plate 35. Then the switching mechanism *a* is opened.

When the revolving switch plate 35 is turned clockwise by 30°, caused by the revolution of the time wheel, the said revolving switch plate 35 comes in contact with the said primary and secondary contact pieces 37, 38, the switching mechanism *a* is closed to cause the buzzer 43 to start buzzing (when 5 minutes have elapsed). Thus any desired alarm time separated by 5-minute intervals can be set in such a manner as set forth above, time-telling is carried out at the desired alarm time.

In the case of setting the alarm device so as to give alarm at intervals of 25 minutes instead of intervals of 5 minutes, what is required therefor is to increase the number of the shift teeth 10 on the minute time wheel 8 up to as many as 4 sets, and, in the case of the 10-minute time wheel 11, the only thing to do is to effectuate an alteration in design in the like manner as what is set forth in the case of the example given above. In this case, the indicating wheel 17 would have alarm time indications 22 marked at such minute intervals (25 minutes, in this case) as can be found by dividing 10 minutes into equal parts by the number (4, in this case) of the shift teeth 10 of the minute time wheel 8.

In the case of the present embodiment, a driving mechanism is additionally set in place to alter the call or alarm time. The said 5-minute indicating wheel 17 has a ratchet wheel 44 arranged in place in an integrated and connected manner at the lower portion thereof, and the said ratchet wheel 44 has a predetermined number of ratchet teeth each conforming with the angle of one intermittent rotation of the 10-minute time wheel 11 in the angle of one pitch of the pawl thereof. The base plate 30 has one end of the driving lever 45 supported by a pin 46 in such a manner as to be free to rock, and has a pawl having arms 47, 48 and 49 extended into a trifurcated shape connected with the top of the lever by a pin 50 in such a manner as to be free to rock. 51 is a spring for pressing the driving lever 45 in the counterclockwise direction, 52 is a spring for pressing the pawl in the clockwise direction, 53 is a stopper for controlling the rocking of the pawl, and 54 is a control lever for stopping the buzzing and for controlling the pawl, one end of the lever being so supported as to be free to slide into engagement with the intermediate portion of the driving lever 45. In this case, the ratchet wheel 44 is so designed as to be revolved by as much as one pitch every time the driving lever 45 makes one rocking stroke.

Now, when the control lever 54 is pushed while in such a state as shown in FIG. 2 wherein time-telling of 12 o'clock is set, the driving lever 45 rocks and moves in the clockwise direction, the pawl arm 47 revolves the ratchet wheel by one pitch (30° ), and the indicating wheel 17 is revolved likewise by 30° in a corresponding manner, thus changing the indication to be 12:05. Thus, the following time-telling is effectuated at the intervals of every 5 minutes.

In FIG. 1, the digital indication mechanism (not shown in the drawing) of a clock is put in actuation by way of respective contact pieces 55 . . . , 56 . . . , and 57 . . . as come in contact with the switch plates arranged in place on the lower surface of the respective time wheels 8, 11, and 14, and, in this case, the material for, and the dimensions of, the switch plates are to be properly selected in the design thereof in correspondence to the speed of revolution of each time wheel.

The minute-interval alarming device for a clock or the like introduced in the present device enables alarm time telling to be properly conducted at such fractional minute intervals as 5 minutes, 25 minutes, or the like, thus proving quite convenient in use. Furthermore, now that proper time-telling can be conducted by such a simple constitution as to have only the number of the shift teeth of the minute time wheel modified in an appropriate manner, the said minute-interval alarming device is advantageous in that it not only is virtually the same as the conventional 10-minute alarming device in terms of the number of the component parts employed therefor, the fitting space required therefor, and the manufacturing cost thereof, but also can be put to working thereof soon enough for proper materialization simply by slightly modifying a conventional 10-minute alarming device.

What is claimed is:

1. An alarming device for a clock and the like comprising: a rotatable minute time wheel; means for intermittently driving said minute time wheel through angular distances representing minutes; a rotatable 10-minute time wheel positioned to intermittently mesh with said minute time wheel so as to be intermittently driven thereby through angular distances representing 10 minutes, one of said minute and 10-minute time wheels having a plurality of angularly spaced apart shift teeth portions, separated by non-toothed portions, which intermittently mesh with a continuously toothed portion of the other wheel; a rotatable hour time wheel positioned to intermittently mesh with said 10-minute time wheel so as to be intermittently driven thereby through angular distances representing hours; first and second angularly adjustable detection devices for respectively detecting when the 10-minute and hour time wheels are in predetermined angular positions, said first detection device containing alarm time indicating indicia each of which represents one-figure minutes selected in accordance with the number of said shift teeth, and said second detection device containing alarm time indicating indicia representing hours; setting means for setting said detection devices in angular positions corresponding to a time at which it is desired that an alarm should be given; and audible alarm means rendered operative only when the 10-minute time wheel and the first detection device, and the hour time wheel and the second detection device, are in corresponding angular positions to provide an audible alarm.

2. An alarming device according to claim 1; including an actuating member spaced from said setting means and manually movable from an inoperative position and into an operative position in which it drivingly engages a predetermined detection device to adjust the angular position thereof, each movement of said actuating member into the operative position adjusting the position of the said predetermined detection device by a constant amount.

3. An alarming device according to claim 2; wherein said actuating member comprises a pawl which, when in the operative position, engages a ratchet wheel drivingly connected to the said predetermined detection device.

4. An alarming device according to claim 3; wherein said pawl is carried by a lever which is engaged by a setting pin and which is biassed to a position in which said pawl is spaced from said ratchet wheel, said setting pin being manually movable to move said lever against the said bias and into a position in which said pawl drivingly engages said ratchet wheel.

5. An alarming device according to claim 2; wherein said audible alarm means comprises electrical contact members connected respectively to said detection devices and said time wheels, and fixed contacts coacting with said contact members to make contact therewith only when said time wheels and said detection devices are in the said corresponding angular positions.

6. An alarming device according to claim 2; including means responsive to each movement of said actuating member into the operative position to adjust the position of said predetermined detection device by a constant amount corresponding to 5 minutes.

7. An alarming device for a clock and the like comprising: a rotatable minute time wheel; means for intermittently driving said minute time wheel through angular distances representing minutes; a rotatable 10-minute time wheel positioned to intermittently mesh with said minute time wheel so as to be intermittently driven thereby through angular distances representing 10 minutes, one of said minute and 10-minute time wheels having a plurality of angularly spaced apart shift teeth portions, separated by non-toothed portions, which intermittently mesh with a continuously toothed portion of the other wheel; a rotatable hour time wheel positioned to intermittently mesh with said 10-minute time wheel so as to be intermittently driven thereby through angular distances representing hours; first and second angularly adjustable detection devices for respectively detecting when the 10-minute and hour time wheels are in predetermined angular positions and including means defining indicating indicia for indicating the desired call time at which an alarm should be given; setting means for setting said detection devices in angular positions corresponding to said desired call time and including means for setting said first detection device to detect call times at 5-minute increments or less; and audible alarm means rendered operative only when the 10-minute time wheel and the first detection device, and the hour time wheel and the second detection device, are in corresponding angular positions to provide an audible alarm.

* * * * *